US006394483B2

(12) United States Patent
Stubblefield

(10) Patent No.: US 6,394,483 B2
(45) **Date of Patent: *May 28, 2002**

(54) SNOWBOARD BODY

(75) Inventor: Donald P. Stubblefield, Beaverton, OR (US)

(73) Assignee: North Shore Partners, Lake Oswego, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/974,287

(22) Filed: Nov. 19, 1997

(51) Int. Cl.[7] ..... A63C 5/07
(52) U.S. Cl. ..... 280/602; 280/14.2
(58) Field of Search ..... 280/14.2, 609, 280/607, 601, 602, 22

(56) References Cited

U.S. PATENT DOCUMENTS

| | | | | | |
|---|---|---|---|---|---|
| 2,318,147 | A | * | 5/1943 | Ericson | 280/14.2 |
| 4,163,565 | A | * | 8/1979 | Weber | 280/14.2 |
| 4,974,868 | A | * | 12/1990 | Morris | 280/14.2 |
| 4,995,631 | A | | 2/1991 | Hunter | |
| 5,018,760 | A | | 5/1991 | Remondet | |
| 5,261,689 | A | | 11/1993 | Carpenter et al. | |
| 5,413,371 | A | * | 5/1995 | Trimble | 280/607 |
| 5,462,304 | A | | 10/1995 | Nyman | |
| 5,464,242 | A | * | 11/1995 | Commier et al. | 280/602 |
| 5,573,264 | A | * | 11/1996 | Deville et al. | 280/14.2 |
| 5,823,562 | A | * | 10/1998 | Stubblefield | 280/609 |
| 5,954,356 | A | * | 9/1999 | Bubsy, Jr. et al. | 280/602 |
| 6,293,567 | B1 | * | 9/2001 | Menges | 280/14.21 |

FOREIGN PATENT DOCUMENTS

| | | |
|---|---|---|
| DE | G9217464 U | 2/1993 |
| DE | 4207768 A | 9/1993 |
| FR | 2704155 A | 10/1994 |

* cited by examiner

*Primary Examiner*—Robert P. Olszewski
*Assistant Examiner*—Michael Cuff
(74) *Attorney, Agent, or Firm*—SAIDMAN DesignLaw Group

(57) ABSTRACT

A snowboard whose base is relatively thick in the mounting zones beneath each of the rider's feet and relatively thin between the two mounting zones. Thus, with normal loading applied through the rider's feet to the snowboard, the board will bow into a reasonably good approximation of an arc having a constant radius. Consequently, the portions of the snowboard coming in contact with the surface of the snow will substantially lie on segments of a circular arc, and the back half of the snowboard will substantially follow in the track of the front half of the snowboard. This is achieved by controlling the flexural rigidity in the mounting zones and in the center section between the mounting zones. The curvature of the snowboard in response to the application of forces by its rider is a function of the Area Moment of Inertia (I) of the transverse cross-sectional areas along the snowboard's length. In turn, the Area Moment of Inertia is a function of the geometry of the transverse cross-section. The invention is principally concerned, therefore, with the appropriate selection of the geometry of the transverse cross-section of the various segments of the snowboard's body.

7 Claims, 4 Drawing Sheets

SNOWBOARD BODY

BACKGROUND OF THE INVENTION

1. Field of the Invention

This invention relates to snowboards, and, more particularly, to improving the performance of a snowboard by designing it such that it will bow under a load into a curve of substantially constant radius.

2. Description of Related Art

When a snowboarder makes a turn, asymmetrical pressure is applied through the rider's two feet to the snowboard. Ideally, the shifting of the rider's weight should both rotate the board about its longitudinal axis, bringing the snowboard up onto one edge and balancing it there, and arch the snowboard longitudinally into a bow with the radius of curvature of the bow extending upwardly away from the snow's surface. If this is achieved, the edge of the board will make a slender cut in the snow, the result of the back half of the board following in the track of the front half of the board, and the rider is said to "carve" a turn. This is the ideal turn, for it cuts down on the friction or drag felt by the board as it travels through the snow. This is the easiest turn to control.

It is all too common, however, for the back half of the board to cut its own path through the snow. This is undesirable, for not only does it create control problems, it doubles the friction or drag experienced by the board. The main cause of dual tracking of a board on edge is that the longitudinal curvature of the board is not circular; inevitably it comprises a curve of varying radii, usually including an essentially flat portion in the middle of the board. If the edge of the board in contact with the snow were to form an arc with a single radius, i.e., the curvature of the cutting edge coincides with a segment of a circle, the back half of the board would have to follow in the same track as the front half. However, it is not easy for a snowboarder to control the forces applied by his/her two feet sufficiently finely to cause a board to have a constant radius of curvature; in fact, with existing boards, it is virtually impossible.

I have determined that the problem in carving perfect turns lies not so much in the skills of the rider as in the construction of the board itself, mainly in the resistance of current snowboards to being bent into a circular arc under the loads applied thereto.

Snowboards currently in the marketplace have bodies with vertical thicknesses which resist bending of the longitudinal dimension of the snowboard into a circular arc. Representative of the prior art are Remondet, U.S. Pat. No. 5,018,760, Carpenter et al., U.S. Pat. No. 5,261,689, and Nyman, U.S. Pat. No. 5,462,304.

Remondet shows (FIG. 4) a board having a single camber with the variation in thickness along its longitudinal centerline being a maximum in the center of the board and diminishing in both directions toward the tail and nose. Thus, not only does the center section have the least flexibility and thereby resists bending the most, but, because of the camber, the center section is convex, i.e., it is bowed with the radius of curvature pointing in the wrong direction, namely, downwardly toward the surface of the snow. A rider cannot apply any combination of pressures which will bend the central portion of the snowboard into a concave circular arc.

Carpenter et al. show (FIG. 1) a snowboard having thinner fore and aft sections separated by a thicker central platform having an essentially constant thickness. While being more flexible than Remondet's board, the central platform is still the thickest part of the board, and consequently is resistant to bending.

Nyman shows (FIG. 2) a snowboard having a single camber and an essentially constant thickness from nose to tail (it is not clear whether the constant thickness is an intended characteristic of Nyman's snowboard, or whether it is merely the draftsman's contribution, for the thickness of the board is not mentioned in his specification). Nyman's board acts more like a simple beam, and, if uniform in elasticity along its length, will bend essentially uniformly. The single camber, however, absorbs the bending effects, causing the board to straighten rather than to bow concavely.

Most prior art snowboards have a single camber, causing the usual prior art snowboard to contact the snow only with two widely separated segments of the snowboard near the nose and tail. The rider is supported between these segments, and although the distance between them is decreased as the camber is compressed slightly by the loading, the separation is still quite large. When turning, the snowboard will ride on the edges of these snow-contacting segments, which become in effect small arcs of an imaginary circle having a radius dependent on their separation. When the edge segments are widely separated, the radius of the circle is large, and the radius of the turn is large also. Smaller separations between edge segments produce sharper, tighter turns. Because of the inherent inability of prior art snowboards to bend in their central sections, they favor long, languid turns. Tight, abrupt turns are effected only by the rider imposing extremely complex combinations of weight shifts on the board. In effect, the rider has to fight the board in order to properly control it.

Most prior art snowboards include side cuts which narrow the central portion of the snowboard. Side cuts have two primary effects. One, they improve the board's flexibility slightly, and although this contributes to its bowing, other design considerations (mainly their thicknesses and their single camber) tend to negate the effect. Two, the side cuts change the separation of the snow-contacting edge segments. Increasing (or decreasing) the amount of the compression of the camber decreases (or increases) the distance between them. These factors aid in the performance of the snowboard, but because prior art snowboards are inherently incapable of bowing, they are still very difficult to control.

OBJECTS AND SUMMARY OF THE INVENTION

The present invention overcomes the difficulties described above by providing a snowboard such that under normal loading, the snowboard will naturally bow into an arc having a radius which is substantially constant. Consequently, the edge segments of the snowboard coming in contact with the surface of the snow will substantially be portions of a circular arc, and the back half of the snowboard will substantially follow the track of the front half of the snowboard.

An explanation of the meaning of "normal loading," as used in the specification and claims, is appropriate here. When a rider is supported by a snowboard, the loading applied throughout the snowboard is defined by the length of the snowboard, the feet placement on the board, and the weight of the rider. The length of the snowboard and the weight of the rider is fixed for any given situation. Consequently, the loading depends on the placement of the feet on the board. The rider's feet are secured to the snowboard by means of bindings fixed to the snowboard. The bindings are not usually limited to being attached to the snowboard in only one location, however. Provision is made for varying the location of the bindings both longitudinally and transversely of the snowboard, usually in the form of two arrays, one for each binding, of threaded inserts embedded in the body of the snowboard. Each array, and its immediate surrounding area, defines a segment of the board which we are calling a "mounting zone". Each snowboard has two mounting zones separated longitudinally along the length of the snowboard. When the bindings are secured within the mounting zones, the loading of the board by the rider is what is referred to herein as "normal loading". It is the purpose of this invention, as will be brought out in more detail hereinafter, to provide a snowboard which, when subjected to loads within "normal loading," will bow into a reasonably close approximation of a constant radius arc.

It is therefore an object of the invention to provide a snowboard which is constructed to assist the rider in the carving of perfect turns.

It is a further object of the invention to provide a snowboard which, under normal loading, will flex such as to conform the body thereof to a reasonable approximation of a circular arc, thereby producing a turn which approximates the carving of a perfect turn.

It is a further object of the invention to provide a snowboard in which the flexures of the zones directly beneath the rider's feet relative to flexure of the zone between the rider's feet, in combination with the elastic properties of the materials from which the snowboard is constructed, permits the snowboard under normal loading to naturally bow into an arc having a substantially constant radius.

It is a further object of the invention to provide a snowboard in which the central section of the snowboard extending between the rider's feet has a smaller Area Moment of Inertia than that under the mounting zones, thereby providing a flexure such that the board will respond naturally to the rider and assume the curvature of a segment of a circle.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
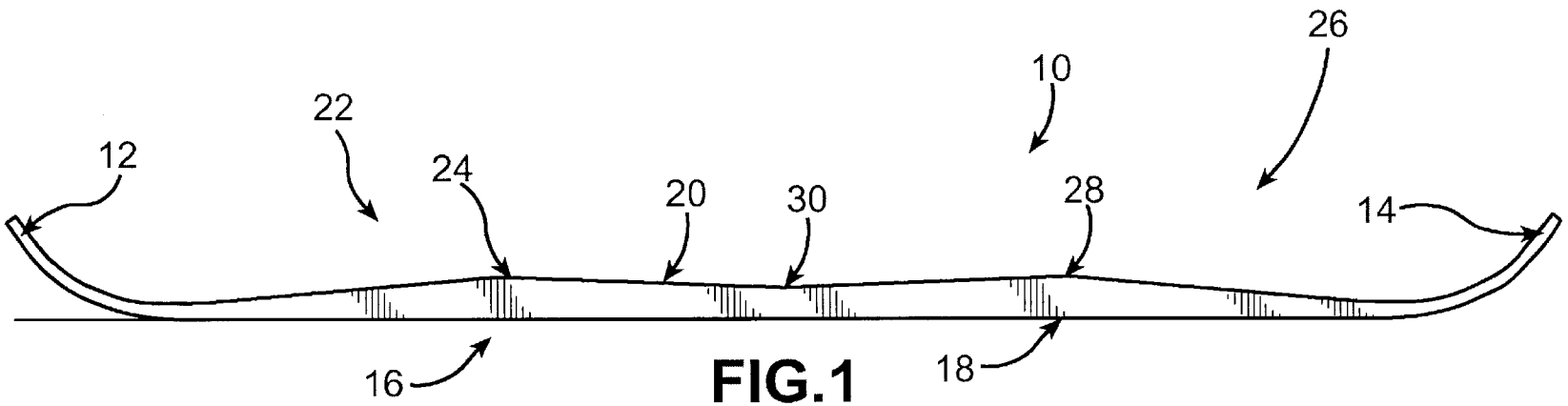
FIG. 1 is a side view of a snowboard which illustrates a preferred embodiment of the present invention.

Before discussing the drawings in detail, a discussion of a few general concepts descriptive of the principles behind the invention is in order.

From the point of view of its general operational characteristics, a snowboard can be considered as a beam and a snowboard with a rider thereon as a beam under a load.

One skilled in the art of beam mechanics is familiar with the well known equation:

$$C=1/\rho=M/(EI) \tag{1}$$

where

C=the curvature of the beam

ρ=the radius of curvature of the beam

M=the Bending Moment of the beam

E=the Modulus of Elasticity of the beam, and

I=the Area Moment of Inertia of the beam.

See Beer, Ferdinand Pierre: MECHANICS OF MATERIALS, Von Hoffman Press, Inc., 1981, pp. 153–159, 438–447, and 579–583, incorporated herein by reference, for a detailed discussion of these concepts.

As is apparent from equation (1), the curvature of the beam is directly proportional to the load bending the beam (Bending Moment, M). As applied to snowboards, the loading is determined by the length of the snowboard, the feet placement on the board, and the weight of the rider. As a preliminary to designing the structure of the snowboard, these variables may be considered as constants. The curvature is also inversely proportional to the Modulus of Elasticity of the materials comprising the board and to the Area Moment of Inertia of the cross-sectional area transverse to any point along the longitudinal axis of the board. The Modulus of Elasticity is either uniform throughout the snowboard, or at least is known as a function of the length of the snowboard, so for design purposes, it too may be considered a constant. This leaves the Area Moment of Inertia as the operative variable in controlling the flexure of the snowboard at any point along its length. The term "controlling" as used herein and in the claims, as in the phrase "means for controlling the flexibility (or flexure)," is intended to indicate that the values of a variable parameter are "controlled" (i.e., consciously selected) during design and manufacture of the snowboard to achieve the desired flexibility of each of the successive transverse cross-sectional areas along its length. After the snowboard has been manufactured, its flexibility is fixed. It is not intended to imply that the snowboard's flexibility is varied at will after manufacture.

For a given loading M and a given Elasticity E, the curvature of the snowboard is less, i.e., flatter, for large values of the Area Moment of Inertia I and greater, i.e. more curved, for small values of I. That is, for large values of I, the board will not deflect as much under a given load than it will for small values of I. One should, therefore, select large values of I for cross-sectional areas in segments of the snowboard which are desired to be stiffer, and small values of I for cross-sectional areas in segments of the snowboard which are desired to be more flexible.

As used in the specification and claims, the flexibility of segments of the snowboard are determined by placing each segment under a known, fixed load. Segments that bend less are less flexible, and segments that bend more are more flexible. Consequently, the relative flexibilities of the various segments are amenable to direct, visual testing.

The person skilled in the art to which this disclosure is directed is either a mechanical engineer or a person having commensurate experience in the field of the mechanics of materials. Such a person is aware that the formula for calculating the Area Moment of Inertia is given in equation (2):

$$[|m]=\iint y^2 da \tag{2}$$

where

I=Area Moment of Inertia of the area, y=distance to the differential area from a reference point, and da=the differential area.

See Beer, supra, page 157. From the mathematical definition of Area Moment of Inertia, it can be seen that the Area Moment of Inertia I depends only on the geometry of the cross section of the beam, i.e., its cross-sectional shape. Equation (2) has been applied to common shapes, e.g., rectangles, triangle, circles, semi-circles, etc., with known results. To wit:

$$\text{Rectangle: } I=bh^3/12 \quad (3)$$

$$\text{Triangle: } I=bh^3/36 \quad (4)$$

$$\text{Circle: } I=\pi r^4/4 \quad (5)$$

$$\text{Semi-circle: } I=\pi r^4/8 \quad (6)$$

where

I=the Area Moment of Inertia of the area, b=width of the base of the area, h=the height of the area, and r=the radius of the circle and/or semi-circle.

These equations show that the Area Moment of Inertia I is more sensitive to the height of the cross-sectional area than it is to the width of the area.

The Area Moment of Inertia of complex shapes can be determined by subdividing the complex shapes into parts having simpler shapes and by summing the Area Moments of Inertia of the parts, as is known by those skilled in the art. Beer, supra, pp. 443–447.

While one skilled in the art is readily familiar with the concept of Area Moment of Inertia and equations (2)–(6) as applied to the bending of beams, for the benefit of those not as familiar with the concepts, a feel for them sufficient for our purposes can be gleaned from the following simple examples from everyday life.

Consider a common one-by-eight plank, i.e., a board of any particular length having a rectangular cross-section of 1 inch by 8 inches, placed across a chasm side-by-side with a two-by-four of similar length. Experience tells us that the plank will bend much more (have a higher curvature) than will the two-by-four under the same load, say a person crossing the chasm on them. This can also be seen by referring to equation (3), supra. The plank has a smaller Area Moment of Inertia than does the two-by-four, even though they both have the same cross-sectional area, so it is more flexible. Turn the two-by-four on edge with the four inches extending vertically and the Area Moment of Inertia increases, thereby increasing the rigidity of the board. This is true because the Area Moment of Inertia for rectangles increases linearly with width and cubically with height; thus, the height of the area is the controlling factor.

Applying this knowledge to a snowboard, where the height of the cross-sectional area corresponds to the vertical thickness of the board, it is readily apparent that a thicker board is stiffer than a thinner board. This dependence of the Area Moment of Inertia on the vertical thickness of the board is utilized in the preferred embodiments disclosed below in FIGS. 1–6. It is to be emphasized, however, that other cross-sectional configurations, such as those shown in FIG. 7, are equivalent structures within the scope of the appended claims, since by properly selecting their geometric dimensions, they will all have equivalent Area Moments of Inertia. The critical design characteristic is the cross-sectional Area Moment of Inertia. How the geometry of the cross-sectional area is configured is irrelevant, so long as the Area Moments of Inertia are properly selected.

Consider now the snowboard shown in FIG. 1, where there is shown a first preferred embodiment of the present invention. As shown therein in a side view, a snowboard 10 has a nose 12, a tail 14, and a body indicated generally by reference numeral 16.

Body 16 includes a base 18, a top 20, a front half 22 including a front mounting zone 24, and a rear half 26 including a rear mounting zone 28. The front half 22 and rear half 26, and thereby said front and rear mounting zones 24 and 28, are separated by a center section 30. (The separate regions, areas, zones, sections, portions, and segments of the snowboard of the invention are discussed herein as if they are separate entities. This is for clarity of discussion only. In fact, the inventive snowboard is an integral structure from nose to tail.)

FIG. 1 depicts a snowboard resting on the surface of the snow without being loaded by the weight of a rider. Base 18 in this condition is flat.

In accordance with the present invention, also shown in FIG. 1, the vertical thickness of body 16 changes from base 18 to top 20 as a function of distance from nose 12 to tail 14 along the length of snowboard 10. In this preferred embodiment, the thicknesses shown are constant as viewed transversely of the snowboard. That is, the cross-sectional shape of any cross-section taken perpendicular to the longitudinal axis will be essentially a rectangle, similar to the one shown in FIG. 7(*a*). The corners may be rounded for aesthetic or functional reasons, as suggested in FIG. 7(*b*), but other than this slight modification, the thickness is essentially uniform across the board. As can be seen in FIG. 1, the thickness of snowboard 10 is relatively thin throughout the upturned curvature of nose 12, thicker in the front mounting zone 24, thinner in center section 30 between front mounting zone 24 and rear mounting zone 28, thicker again in rear mounting zone 28, and thinner again through tail 14. The exact boundaries between the sections identified above, namely, nose, front mounting zone, center section, rear mounting zone, and tail, are not precisely defined, nor do they need be. Mounting zones 24 and 28 are those areas which support the rider's boots, which as stated above can be variably placed both fore and aft and side to side, as is well known in the art. The nose and tail sections extend outboard from the closest mounting zone, and the center section extends between the mounting zones. The exact locations of the boundaries may change from board to board, but they are characterized by the relative thicknesses and thinnesses as defined above. It should be understood that the drawings do not show exact proportions for thicknesses, but rather are exaggerated for clarity.

The most visible difference between snowboard 10 and prior art snowboards is that center section 30 is relatively thin instead of being the thickest part of the snowboard. Making center section 30 thinner permits snowboard 10 to bend more readily under smaller rider-imposed forces, thereby making snowboard 10 easier to control.

The actual thicknesses of the various sections of the snowboard of the present invention are dependent upon the materials used and the length of the snowboard. In manufacturing the snowboard of the instant invention, the flexibility of the materials used in combination with the values of the variations in thickness along the length of snowboard 10 are selected so that under normal loading, as defined above, snowboard 10 will bow into a smooth curve of substantially constant radius.

The amount of bowing will depend on the magnitude of the load applied thereto, increasing with increased load, but regardless of the absolute value of the load, the board will bow into a curve of substantially constant radius.

The values of the Area Moments of Inertia I as a function of board length are selected according to the invention such that snowboard 10 will bend into a curve having a constant radius for a particular placement of the bindings in each mounting zone. Deviations from that placement, of either or both bindings, will result in a slight deviation from a constant radius curvature. However, regardless of where each binding is placed, so long as they remain fixed in the mounting zones, the radius of curvature as measured along body 16, excluding the curvatures of nose and tail, will approximate a constant with reasonable closeness.

The thicknesses of the mounting zones are thicker in order to provide structural strength for supporting the rider and to not be overwhelmed by the highly localized forces of the rider's two feet and still attain the desired result of bending appropriately for forming a circular arc in combination with center section 30. Conversely, the thinness of center section 30 is thin enough that, when the snowboarder shifts his/her weight in a normal manner so as to direct a turn, snowboard 10 will respond by assuming with the mounting zones a circular arc of a radius commensurate with the weight shifts. Under those conditions, snowboard 10 will make the turn expected. That is, snowboard 10 will carve a turn in the snow in which rear half 26 substantially follows in the track of front half 22.

In models constructed to verify the principles of the present invention, the thickness of center section 30 ranged between about 69% and 79% of the thickness of the mounting zones 24, 28. However, a thickness of the center section 30 that is 95% or less than that of mounting zones 24, 28 will meet the objectives of the present invention.

Figure 2:
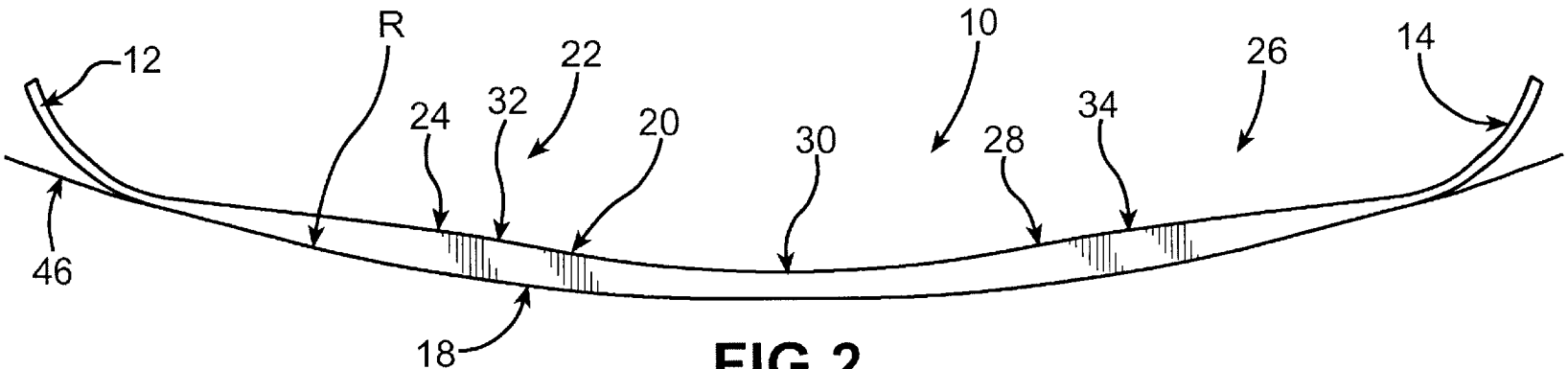
FIG. 2 is a side view of the invention shown in FIG. 1 when under normal loading due to a rider.

FIG. 2 shows snowboard 10 under the load imposed thereon by a rider. The weight of the rider is applied to snowboard 10 in two separated locations, indicated by arrows 32 and 34, in mounting zones 24 and 28.

In general, other than ice or hard packed snow, snow is proportionally resistant to the weights applied thereto. That is, snow will depress further under heavier weights than it will under lighter weights, as evidenced by the tracks of different people walking through the snow. In FIG. 2, loading snowboard 10 at two separated locations 32 and 34 causes snowboard 10 to depress in the middle, as if supported on two fulcrums outboard of mounting zones 24 and 28. As before stated, according to the principles of the invention, for a snowboard to perform correctly it needs to bend under loading into a circular arc. As shown in FIG. 2, base 18 of snowboard 10 is curved to approximate a segment of a circle having a constant radius R. FIG. 2 shows the curvature snowboard 10 assumes under a static load. When carving a turn, snowboard 10 will ride on one edge of body 16. As is known, a skilled rider has it within his/her athletic abilities to alter radius R by varying the different centripetal and centrifugal forces applied thereto by the rider's weight shifts. Inasmuch as body 16 will bend into a circular arc under any of the loading values, that edge on which snowboard 10 rides will form a circular arc, rear half 26 will follow in the track of front half 22, and the rider will have carved the perfect turn. As before alluded to, the value of radius R determines the sharpness of the turn of snowboard 10, namely, for larger values of R, snowboard 10 will turn through a long, sweeping curve, and for smaller R values, the turn is tighter. By allowing center section 30 to bend more readily than prior art snowboards, snowboarders will find snowboard 10 easier to controllably bend into preselected curvatures than prior art snowboards. The inventive snowboard, therefore, is designed to work with riders, instead of fighting them.

In the first preferred embodiment shown in FIGS. 1 and 2, base 18 is flat in repose, i.e., it has no camber. As will become apparent, although this embodiment permits the thickness criteria to be visualized most clearly, base 18 may assume other shapes and still remain within the teachings of the present invention.

Figure 3:
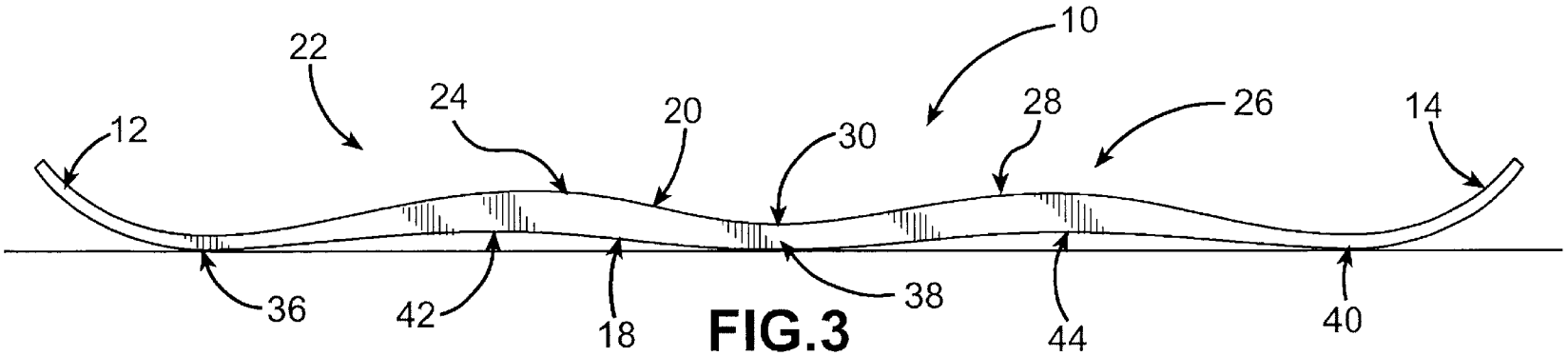
FIG. 3 is a side view of a snowboard which illustrates a second preferred embodiment of the present invention.

FIG. 3 shows a second preferred embodiment of the present invention. As before, FIG. 3 depicts a side view of snowboard 10 having a nose 12, a tail 14, and a body 16. Body 16 includes a base 18, a top 20, a front half 22 including a front mounting zone 24, and a rear half 26 including a rear mounting zone 28, separated by a center section 30. Snowboard 10 in FIG. 3 is resting on the surface of the snow without a rider mounted thereon. Base 18 is unstressed and rests on the snow on three riding areas 36, 38, and 40. As in the first preferred embodiment, snowboard 10 is thinnest in the areas of nose 12 and tail 14, thinner in center section 30, and thickest under the rider's feet in front mounting zone 24 and rear mounting zone 28.

The embodiment of FIG. 3 shows snowboard 10 as including dual cambers indicated generally by reference numerals 42 and 44. A dual-cambered snowboard is the subject of my prior U.S. utility patent application Ser. No. 08/918,906, filed Aug. 27, 1997, now U.S. Pat. No. 5,823,562, assigned to the same assignee as the present invention, and specifically incorporated herein by reference. Dual cambers afford additional ease of control of snowboard 10, as discussed in my aforementioned patent.

Figure 4:
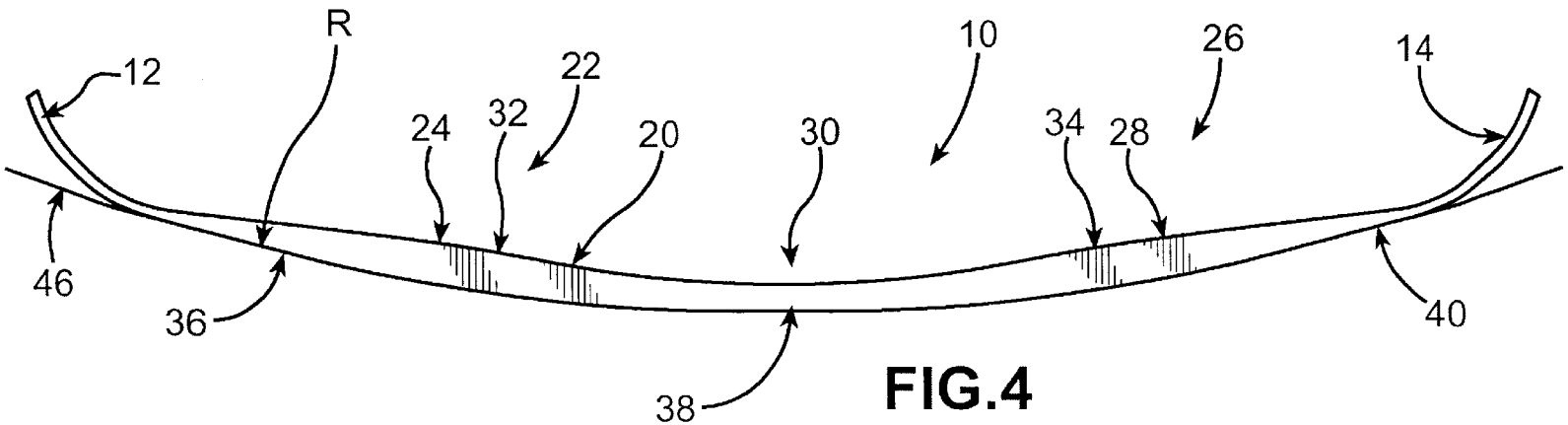
FIG. 4 is a side view of the invention shown in FIG. 3 when loaded.

FIG. 4 shows snowboard 10 of FIG. 3 loaded by a rider. As in the first embodiment, the materials and Area Moments of Inertia are selected to facilitate the bowing of snowboard 10 into a reasonably close approximation of a circular segment of constant radius. Of course, with this embodiment, the flexibility of body 16 must take into account the presence of the two cambers. However, knowing in advance the desired result, bowing into a circular arc, the Area Moments of Inertia in mounting zones 24 and 28 and center section 30 will be selected to achieve that result under normal loading. Having made the proper selections, under the forces imposed by the rider, again indicated by arrows 32 and 34, snowboard 10 will bend into essentially a circular arc of radius R. As in FIG. 2, when snowboard 10 is under a normal loading, body 16 is longitudinally curved, and when turning, the edge which contacts the snow follows an arc of a circle.

Figure 5:
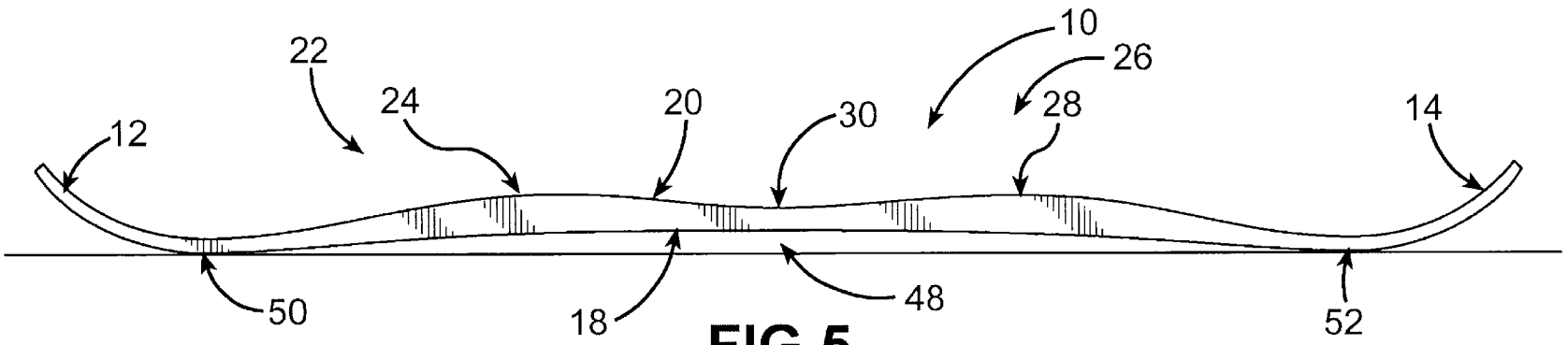
FIG. 5 is a side view of a snowboard which illustrates a third embodiment of the present invention.
Figure 6:
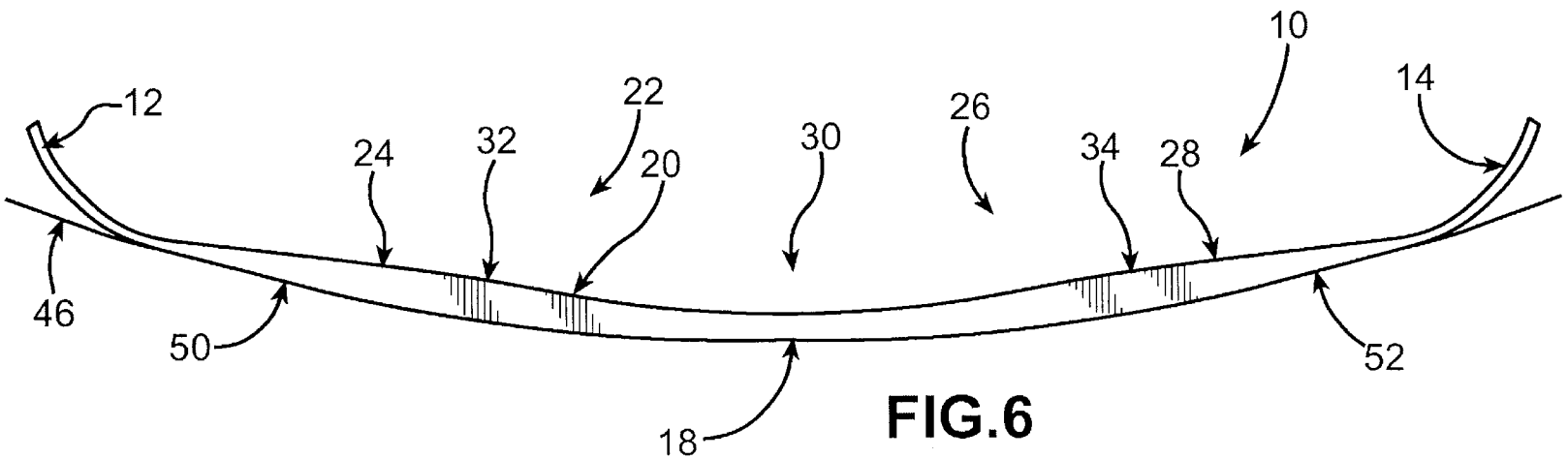
FIG. 6 is a side view of the invention shown in FIG. 5 when loaded.
Figure 7A:
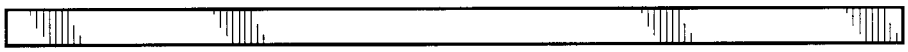
FIGS. 7(*a*)–7(*i*) illustrate preferred embodiments of geometries of cross-sectional areas and a few examples of the many acceptable alternatives which fall within the scope of the inventive concepts disclosed herein.
Figure 7B:
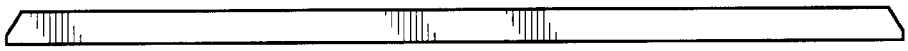
Figure 7C:
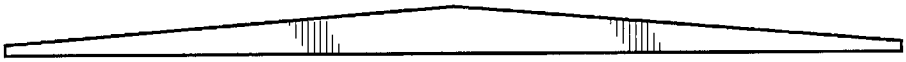
Figure 7D:
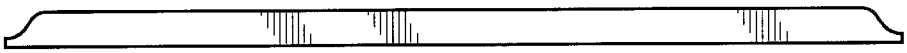
Figure 7E:
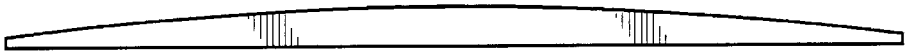
Figure 7F:
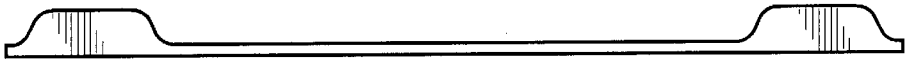
Figure 7G:
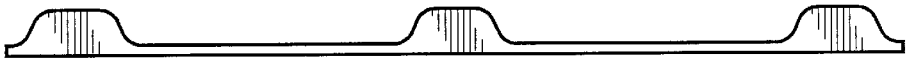
Figure 7H:
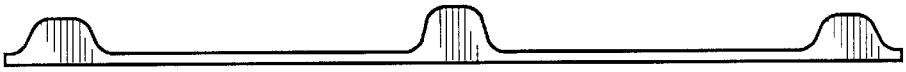
Figure 7I:
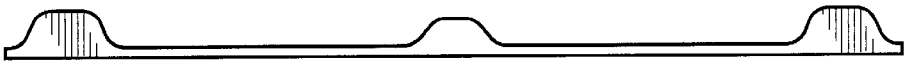

The third embodiment shown in FIGS. 5 and 6 has a single camber 48. The application of the inventive principles disclosed herein to a single camber snowboard is also beneficial. As in the previous embodiments, the variation in thicknesses along the length of snowboard 10 are thinner in nose 12, center section 30, and tail 14 while being thicker in the mounting zones 24 and 28. In the quiescent state shown in FIG. 5, snowboard 10 rests on riding areas 50 and 52. When bowed by the weight of the rider (FIG. 6), riding areas 50 and 52 are flattened and the direction of the camber is reversed, such that, as in the previous embodiments, base 18 is in contact with the snow coincident with an arc of a circle 46 of constant radius R. As before, this is due to proper selections of the Area Moments of Inertia in center section 30, in combination with the flexibility of the materials used, which in this embodiment again results in a thinner center section 30 between mounting zones 24 and 28.

FIGS. 7(*a*)–(*i*) show preferred and acceptable cross-sectional shapes of transverse areas of snowboard 10. All have essentially equivalent Area Moments of Inertia. The shapes shown are merely illustrative of the possibilities and are not exhaustive of the shapes contemplated as falling within the scope of the appended claims. The structural features suggested are not a part of this invention but may form the basis for future patents. For example, the ridges shown in FIGS. 7(*f*)–(*i*) may extend along the full length of the snowboard or stop short of the ends. Their lengths, heights, widths, and materials offer additional means for fine tuning the designer's control over the flexibility of the various sections of the snowboard.

Any of the preceding embodiments can, and preferably do, include side cuts in order to be able to include all of the advantages derivable therefrom. They have not been shown in the drawings, since they are not a part of the inventive concepts claimed below.

It is clear from the above that the objects of the invention have been fulfilled.

Those skilled in the art will appreciate that the conceptions, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the following Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention, which is measured solely by the claims, nor is intended to be limiting as to the scope of the invention in any way.

I claim as my invention:

1. An apparatus for use on a snow surface, comprising:

a nose, a tail, and a body connecting said nose and tail, said body including, a top surface, a bottom surface, a front half, and a rear half, said top and bottom surfaces separated by a thickness;

said body further including a first mounting zone located in said front half and adapted to receive one foot of a rider of said apparatus and a second mounting zone located in said rear half and adapted to receive the other foot of said rider;

said body further including a plurality of cross-sectional portions; and a first static loading condition comprising a first downward load applied to said first mounting zone, a second downward load applied to said second mounting zone, and an upward load applied along said bottom surface;

wherein the value of the following expression is substantially constant when applied to each of said plurality of cross-sectional portions, respectively, and said first static loading condition is applied to said body:

$$M/EI$$

wherein:

E is the modulus of elasticity of said body for said respective cross-sectional portion;

I is the area moment of inertia for said respective cross-sectional portion; and M is the bending moment acting on said respective cross-sectional portion under said first static loading condition.

2. The apparatus of claim 1, wherein said upward load is proportionally resistant to downward loads applied thereto.

3. The apparatus of claim 1, wherein said body further includes a center section located between said first and second mounting zones, and said thickness of said body in said center section is less than said thickness of said body in said first and second mounting zones.

4. The apparatus of claim 3, wherein said thickness of said body in said center section is equal to 95% or less of said thickness of said body in said first and second mounting zones.

5. The apparatus of claim 4, wherein said thickness of said body in said center section is equal to between 69% and 79% of said thickness of said body in said first and second mounting zones.

6. The apparatus of claim 1, further comprising a second static loading condition wherein said body is subjected to no substantial external loading, wherein said bottom surface forms a dual camber when said second static loading condition is applied to said body.

7. The apparatus of claim 1, further comprising a second static loading condition wherein said body is subjected to no substantial external loading, wherein said bottom surface forms a single camber when said second static loading condition is applied to said body.

* * * * *